US010636542B2

(12) United States Patent
Urashita et al.

(10) Patent No.: US 10,636,542 B2
(45) Date of Patent: Apr. 28, 2020

(54) LEAD WIRE

(71) Applicant: TATSUTA Electric Wire & Cable Co., Ltd., Higashiosaka-shi (JP)

(72) Inventors: Kiyotaka Urashita, Kizugawa (JP); Junichi Kinoshita, Kizugawa (JP); Nobuhiro Fujio, Kizugawa (JP); Syoji Nakazono, Kizugawa (JP); Keiichiro Hirose, Kizugawa (JP)

(73) Assignee: TATSUTA Electric Wire & Cable Co., Ltd., Osaka (JP)

( * ) Notice: Subject to any disclaimer, the term of this patent is extended or adjusted under 35 U.S.C. 154(b) by 0 days.

(21) Appl. No.: 16/092,556

(22) PCT Filed: Feb. 21, 2018

(86) PCT No.: PCT/JP2018/006207
§ 371 (c)(1),
(2) Date: Oct. 10, 2018

(87) PCT Pub. No.: WO2018/180036
PCT Pub. Date: Oct. 4, 2018

(65) Prior Publication Data

US 2019/0122787 A1 Apr. 25, 2019

(30) Foreign Application Priority Data

Mar. 29, 2017 (JP) ..... 2017-065172

(51) Int. Cl.

| | |
|---|---|
| ***H01B 7/06*** | (2006.01) |
| ***H01B 7/17*** | (2006.01) |
| ***H01B 1/04*** | (2006.01) |
| ***H01B 7/00*** | (2006.01) |
| *H01B 13/02* | (2006.01) |

(52) U.S. Cl.
CPC ..... *H01B 7/06* (2013.01); *H01B 1/04* (2013.01); *H01B 7/0009* (2013.01); *H01B 7/17* (2013.01); *H01B 7/0018* (2013.01); *H01B 13/02* (2013.01)

(58) Field of Classification Search
CPC ..... H01B 7/06; H01B 7/0009; H01B 7/17; H01B 1/04; H01B 7/0018; H01B 13/02
USPC ..... 174/126.2
See application file for complete search history.

(56) References Cited

U.S. PATENT DOCUMENTS

| | | | | |
|---|---|---|---|---|
| 9,887,021 | B2 | 2/2018 | Li et al. | |
| 2011/0288388 | A1 | 11/2011 | Shah et al. | |
| 2014/0326358 | A1* | 11/2014 | Ushijima | B29C 53/32 138/174 |
| 2017/0136729 | A1* | 5/2017 | Mizo | C22C 49/14 |
| 2017/0236615 | A1 | 8/2017 | Li et al. | |

FOREIGN PATENT DOCUMENTS

| | | |
|---|---|---|
| CN | 101707069 A | 5/2010 |
| CN | 102686159 A | 9/2012 |
| CN | 202711737 U | 1/2013 |

(Continued)

*Primary Examiner* — Tremesha S Willis
(74) *Attorney, Agent, or Firm* — The Webb Law Firm

(57) ABSTRACT

An object of the present invention is to provide a lead wire having a conductor that is hardly pulled out from the lead wire during the peeling process or the like while being formed of carbon fibers. In the present invention, a belt-shaped conductor formed of a plurality of carbon fibers are included in a lead wire having a circular cross section.

7 Claims, 2 Drawing Sheets

(56) References Cited

FOREIGN PATENT DOCUMENTS

| | | | |
|---|---|---|---|
| CN | 105390182 | A | 3/2016 |
| CN | 105575473 | A | 5/2016 |
| JP | 5136582 | A | 3/1976 |
| JP | 63167612 | U | 11/1988 |
| JP | 9131328 | A | 5/1997 |

* cited by examiner

LEAD WIRE

CROSS-REFERENCE TO RELATED APPLICATIONS

This application is the United States national phase of International Application No. PCT/JP2018/006207 filed Feb. 21, 2018, and claims priority to Japanese Patent Application No. 2017-065172 filed Mar. 29, 2017, the disclosures of which are hereby incorporated in their entirety by reference.

FIELD

The present invention relates to a lead wire, and more particularly, to a lead wire with a circular cross section that includes a conductor and a tubular covering material covering the conductor.

BACKGROUND

Conventionally, electric wires are widely used for transferring electric energy. Among these wires, a small-sized wire called a lead wire is frequently used in electric and electronic equipment and the like for transferring weak electric power or electric signals. A general lead wire includes a conductor arranged in its central portion, the conductor having a circular cross section and formed of a single annealed copper wire or a plurality of annealed copper wires bundled together. In the electric wire of this type, the conductor is covered with a tubular covering material formed of a polymer having excellent electrical insulation.

For medical and other applications, use of a lead wire having a conductor formed of carbon fibers has been studied (see Patent Literatures 1 and 2 below).

CITATION LIST

Patent Literature

Patent Literature 1: Japanese Unexamined Utility Model Application Publication No. S63-167612

Patent Literature 2: JP 119-131328 A

SUMMARY

Technical Problem

Generally, the lead wire is available on the market in the form of being wound around a bobbin or the like, and is fed out from the bobbin and then cut off to a certain length for use. In the use of the lead wire, a process in which the covering material at an end of the lead wire is removed using an electric works knife or a wire stripper to cause the conductor at the end to be exposed (hereinafter referred to also as "peeling process") is generally carried out.

In the general peeling process, if, for example, the conductor is to be exposed by 20 mm, the covering material is first cut at the position 20 mm away from an end of the lead wire. At this time, the covering material is cut from the outer surface of the lead wire to such a depth as not to reach the conductor so that the conductor is not damaged. The cut position therefore has thin skin of the covering material remaining around the conductor. Next, the covering material to be removed, which extends from the cut to the end of the lead wire, is nipped and pulled in a lengthwise direction of the lead wire to cut off the thin skin, so that the covering material is removed from the conductor at the end of the lead wire. At this time, the conductor is sometimes pulled out from the lead wire together with the covering material to be removed.

The present inventors have found that a lead wire having a conductor formed of carbon fibers is more susceptible to the problem that the conductor is pulled out during the peeling process than a lead wire having a conductor formed of an annealed copper wire is. Nevertheless, there has previously been no case where such a problem is focused on, and no specific countermeasures against the problem have been taken. An object of the present invention, therefore, is to solve such a problem. That is, an object of the present invention is to provide a lead wire having a conductor that is formed of carbon fibers but still hardly pulled out from the lead wire during the peeling process or the like.

Solution to Problem

As a result of diligent studies in view of the abovementioned purpose, the present inventors have found that a belt-shaped conductor has an increased pull-out resistance, thereby completing the present invention.

In order to solve the abovementioned problem, the present invention provides a lead wire including a belt-shaped conductor formed of a plurality of carbon fibers and a tubular covering material covering the belt-shaped conductor, the lead wire having a circular cross section.

DESCRIPTION OF EMBODIMENTS

An embodiment according to the lead wire of the present invention will be described. Although the intended use of the lead wire of the present invention is not particularly limited, the embodiment will be hereinafter described by taking, for example, a lead wire used between an X-ray irradiating portion and an X-ray receiving portion, of an X-ray apparatus.

Figure 1:
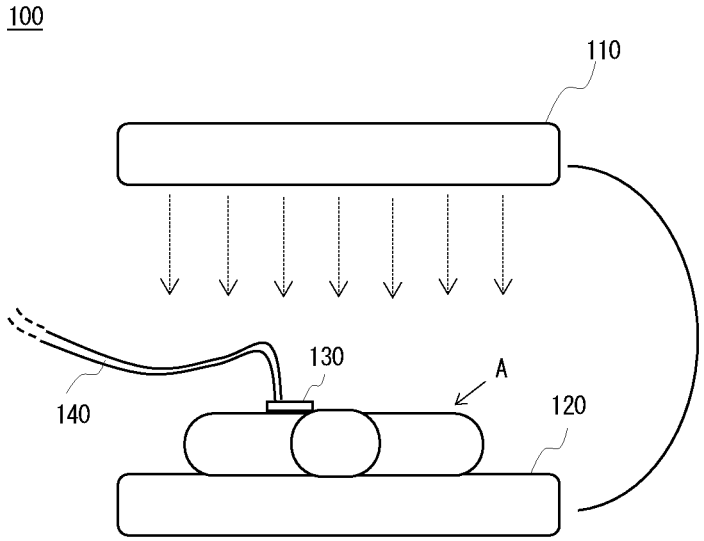
FIG. 1 is a schematic view showing a configuration of an X-ray apparatus.

First, the X-ray apparatus and a method for using the lead wire of this embodiment will be described with reference to drawings. As shown in FIG. 1, an X-ray apparatus 100 of this embodiment includes an X-ray irradiating portion 110 configured to irradiate an object A with X-rays, and an X-ray receiving portion 120 configured to receive X-rays irradiated from the X-ray irradiating portion 110. The X-ray apparatus 100 is configured to be able to acquire an image of the internal state of the object A by arranging the object A between the X-ray irradiating portion 110 and the X-ray receiving portion 120, allowing X-rays irradiated from the X-ray irradiating portion 110 to pass through the object A and reach and the X-ray receiving portion 120. The X-ray apparatus 100 further includes a sensor 130 configured to be attached to the object A, and a signal wire 140 for transferring information obtained by the sensor 130. One end in a lengthwise direction of the signal wire 140 is connected to the sensor 130, and an opposite end thereof is connected to a receiver (not shown) configured to receive signals emitted from the sensor 130. That is, the signal wire 140 is used in conjunction with the object A in an environment subjected to X-rays, in order to provide an electric connection between the receiver and the sensor 130 attached to the object A. The signal wire 140, which is sometimes located within the radiographic range in this application, is preferably formed of a material that minimizes blocking of X-ray transmission. Therefore, as a forming material of a conductor of the signal wire 140, carbon fiber rather than metallic wire such as copper wire and aluminum wires is employed.

Examples of the object A to be radiographed include, for example, humans and animals such as pet animals, and general industrial products.

Figure 2:
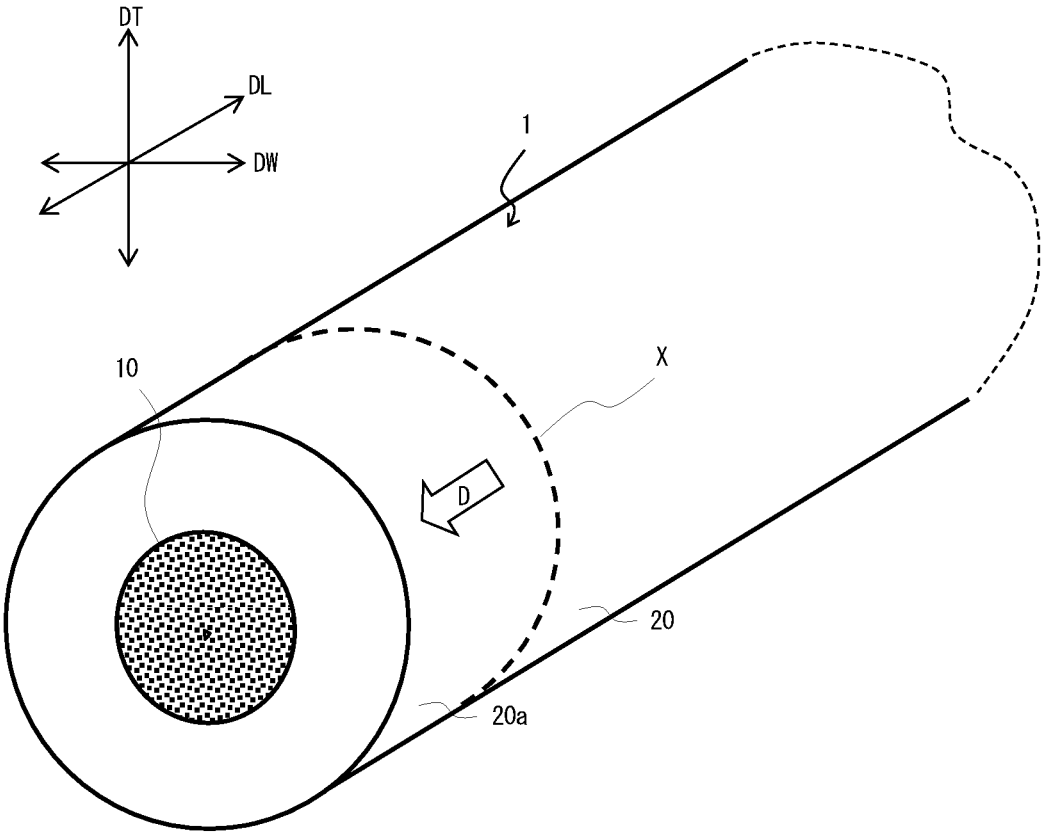
FIG. 2 is a schematic perspective view showing an appearance of a lead wire before a peeling process.
Figure 3:
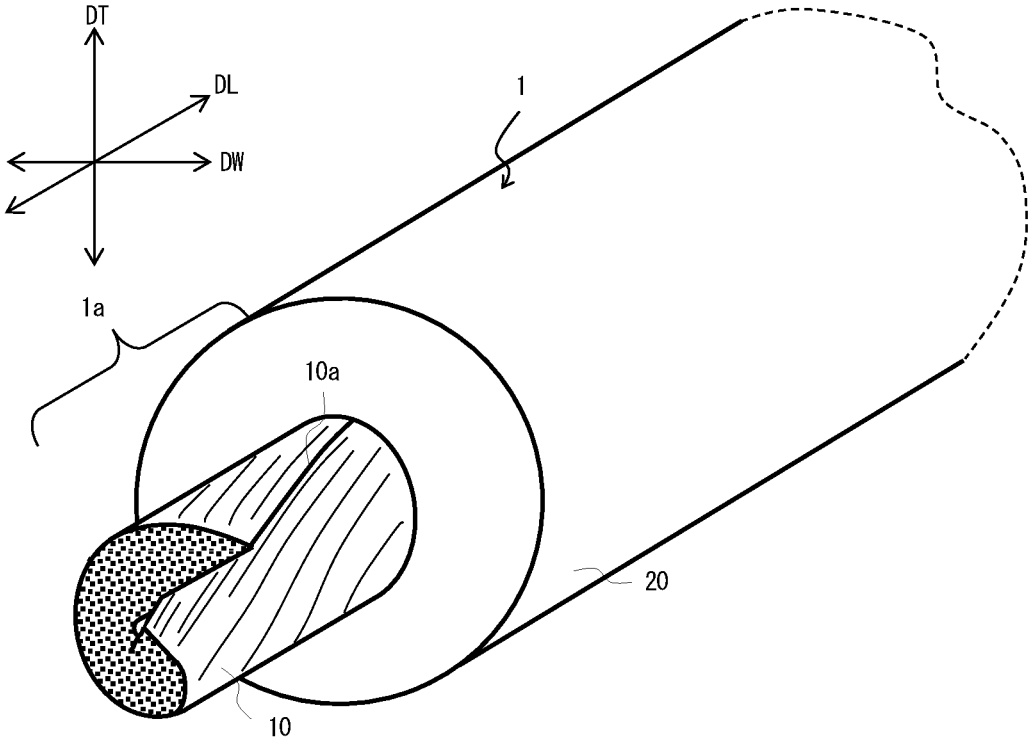
FIG. 3 is a schematic perspective view showing an appearance of the lead wire after the peeling process.
Figure 4:
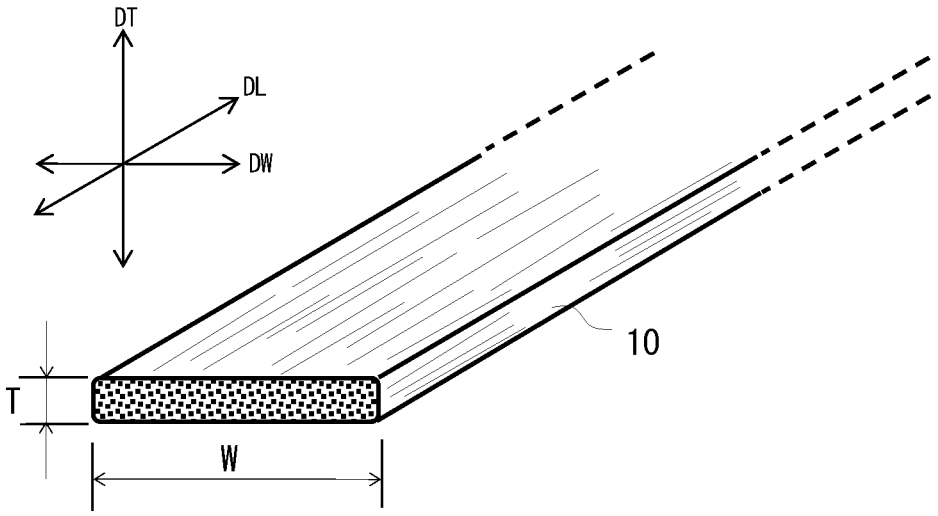
FIG. 4 is a schematic perspective view showing a belt-shaped conductor of the lead wire.

The lead wire in this embodiment is suitable for being used for the abovementioned signal wire 140. As shown in FIGS. 2, 3, and 4, the lead wire 1 in this embodiment is a lead wire with a circular cross section that includes a belt-shaped conductor formed of a plurality of carbon fibers, and a tubular covering material covering the belt-shaped conductor. The plurality of carbon fibers forming the belt-shaped conductor are aligned in parallel with a lengthwise direction of the belt-shaped conductor. That is, the plurality of carbon fibers extend in the lengthwise direction of the belt-shaped conductor and are arranged in parallel with one another to form the conductor. The covering material 20 of the lead wire 1 is in a cylindrical shape, and has a hollow interior of which a cross section is a substantially concentric circle with a circle defining the outer circumference of the lead wire 1 and is smaller than the circle defining the outer circumference. The lead wire in this embodiment includes a belt-shaped conductor 10 that is wider than the diameter (D (mm)) of the hollow interior of the covering material 20. Thus, the belt-shaped conductor has a belt shape in an unbound state and is arranged in a rolled-up state in the hollow interior of the covering material 20.

The diameter (D) of the hollow interior of the covering material 20 is obtained by obtaining the area ($S_1$ ($mm^2$)) of the hollow interior and calculating the diameter of a circle having the same area as the area ($S_1$). The area ($S_1$) of the hollow interior can be obtained by cutting the lead wire 1 along a plane orthogonal to the lengthwise direction DL at several places selected at random in the lengthwise direction of the lead wire, capturing images of the cross sections magnified by a microscope or the like, obtaining the areas of the hollow interior using the captured images, and calculating the arithmetic mean of the cross-sectional areas. The area ($S_1$) of the hollow interior can be obtained by, for example, capturing images of the cross section using a microscope equipped with a CCD camera and, for example, binarizing the images to highlight the contour of the hollow interior. At this time, the area ($S_1$) of the hollow interior is in principle obtained by automatic area extraction using image analysis software. In the case where the automatic area extraction is hard to be executed, the area of an oval having a long diameter and a short diameter may be obtained by extracting the long diameter and the short diameter from a contour shape of the hollow interior and calculating therefrom. The width (W) of the belt-shaped conductor 10 can be obtained by measuring the dimensions in a direction orthogonal to the lengthwise direction DL of the belt-shaped conductor 10 at several places selected at random, and calculating the arithmetic mean of the measured dimensions. In the case where the belt-shaped conductor 10 is curled in an unbound state, the width (W) of the belt-shaped conductor 10 can be measured by, for example, sandwiching the belt-shaped conductor 10 between two glass slides. That is, the width (W) of the belt-shaped conductor 10 can be measured by applying a light load to the belt-shaped conductor 10 so as to press the belt-shaped conductor 10 into a flat shape.

As shown in FIGS. 2 and 3, the covering material 20 is removed at an end of the lead wire 1 of this embodiment to form an exposed conductor portion 1*a* having the belt-shaped conductor 10 exposed (i.e., a peeling process), and the exposed conductor portion 1*a* is used to electrically connect the lead wire 1 to the sensor 130 and the like. At this time, a cut X is provided around the lead wire 1 a certain length inside the end of the lead wire 1. Subsequently, the portion from the cut X to the end of the lead wire 1 is removed as an unnecessary portion 20*a* of the covering material to form the exposed conductor portion 1*a*. The unnecessary portion 20*a* is removed by nipping and pulling the unnecessary portion 20*a* in the lengthwise direction of the lead wire 1. A wire stripper or the like is used for removing the unnecessary portion 20*a*.

As aforementioned, the belt-shaped conductor 10 in the lead wire 1 of this embodiment is arranged in the rolled-up state in the hollow interior of the covering material 20. The belt-shaped conductor 10 can therefore cause a frictional force to act between the belt-shaped conductor 10 and the inner wall surface of the covering material 20, due to the restoring force of the belt-shaped conductor 10 to restore to the state before being rolled-up, wherein the restoring force is the result of the belt-shaped conductor 10 attempting to return to a state prior to being rolled-up. Accordingly, in the lead wire 1 of this embodiment, a pull-out resistance is caused to the belt-shaped conductor 10 when the peeling process is performed using the wire stripper or the like, which thereby suppresses unexpected pull-out of the belt-shaped conductor 10.

Since the lead wire 1 of this embodiment has the belt-shaped conductor 10 arranged in the rolled-up state in the covering material, the carbon fibers forming the belt-shaped conductor 10 show good adhesion, which is effective also for decreasing the resistance of the belt-shaped conductor 10. In order to make more evident the effect of decreasing the resistance of the belt-shaped conductor 10, it is preferable to have a larger number of carbon fibers present in the hollow interior of the covering material 20. More specifically, it is preferable in the lead wire 1 of this embodiment that a filling rate (%) expressed by the formula (1) below be 60% or more and 95% or less, where $S_1$ ($mm^2$) is a cross-sectional area of the hollow interior obtained by cutting the covering material 20 along a plane orthogonal to the lengthwise direction of the lead wire 1, and $S_2$ ($mm^2$) is an area in which the plurality of carbon fibers are present in the hollow interior. The filling rate (%) is more preferably 65% or more and 90% or less.

$$\text{Filling rate } (\%) = (S_2/S_1) \times 100\% \quad (1)$$

The area ($S_2$ ($mm^2$)) in which the plurality of carbon fibers are present in the hollow interior is obtained by multiplying a cross-sectional area of one of the carbon fibers by the number of carbon fibers used for the belt-shaped conductor. The cross-sectional area of the carbon fiber can be obtained by capturing an image of the cross section of the carbon fiber using the scanning electron microscope (SEM), and automatically extracting the cross-sectional area of the carbon fiber from the captured image using the image analysis software. The cross-sectional area of the carbon fiber can be obtained as the arithmetic mean of the data on a plurality of cross-sectional areas that are obtained from a plurality of carbon fibers selected at random from the carbon fibers used for the belt-shaped conductor.

The belt-shaped conductor 10 is preferably arranged in a twisted state in the covering material so that the carbon fibers achieve better adhesion.

The lead wire 1 in this embodiment can be fabricated using, for example, an extruder equipped with a crosshead at the end. The crosshead includes a nipple through which a belt-shaped conductor is inserted, and a die configured to cover the belt-shaped conductor with a covering material after the belt-shaped conductor passes through the nipple. When the belt-shaped conductor 10 is attempted to pass through the nipple without being twisted, the belt-shaped conductor 10 is folded into two or three or more having a fold or folds formed in the lengthwise direction to pass through the nipple. The belt-shaped conductor 10 that has passed through the nipple thereby exerts an excessive restoring force, which generates a force to press the covering material outward from the inside thereof. Consequently, the lead wire 1 to be fabricated may have a cross section in a shape not close to a perfect circle but have projections and recesses in the outer surface. Therefore, it is preferable that the belt-shaped conductor be twisted also to facilitate manufacturing the lead wire 1 having a good finish shape.

The "twist" applied to the belt-shaped conductor 10 is preferably performed at a pitch of more than 5 mm and less than 50 mm. The twist pitch is more preferably 10 mm or more and 40 mm or less. The twist pitch can be obtained, for example, by taking the belt-shaped conductor 10 out from the lead wire 1 while maintaining its state in the covering material as much as possible, and determining the number of twists in a certain length of the taken-out belt-shaped conductor 10. Specifically, when a one-meter-long belt-shaped conductor 10 is twisted X times, the twist pitch is "1000/X" (mm).

The thickness or the like of the lead wire 1 of this embodiment is not particularly limited, but the lead wire 1 of this embodiment when used, for example, for the X-ray apparatus 100 preferably has a diameter of 2 mm or less from the perspective of radiolucency. The thickness of the lead wire 1 is more preferably 1.5 mm or less, further preferably 1.2 mm or less, and particularly preferably 1.0 mm or less. However, the lead wire 1 having an excessively small diameter may be difficult to be manufactured and result in an increased electric resistance per unit length. Thus, the thickness of the lead wire 1 is more preferably 0.2 mm or more, further preferably 0.3 mm or more, particularly preferably 0.5 mm or more.

The hollow interior of the covering material 20 in which the belt-shaped conductor 10 is housed preferably occupies a larger proportion of the lead wire 1 to more effectively downsize the lead wire 1; however, the hollow interior occupying an excessive proportion necessarily makes the covering material 20 thin, which may cause the covering material 20 to be torn or broken in some cases. Therefore, the percentage of the area ($S_1$ ($mm^2$)) of the hollow interior occupying in the cross-sectional area of the lead wire 1 is preferably 25% or more and 80% or less.

The belt-shaped conductor 10 preferably has a higher ratio (flatness ratio) of the width (W) to the thickness (T) to more effectively increase pull-out resistance. Thus, the flatness ratio (W/T) of the belt-shaped conductor 10 is preferably 5 times or more, more preferably 8 times or more, particularly preferably 10 times or more. However, an excessively high flatness ratio of the belt-shaped conductor 10 causes the belt-shaped conductor 10 to be accordingly thin, which may possibly result in a small restoring force from deformation. Therefore, the flatness ratio (W/T) of the belt-shaped conductor 10 is preferably 30 times or less, more preferably 25 times or less, particularly preferably 20 times or less.

As the carbon fibers forming the belt-shaped conductor 10, PAN-based carbon fibers that use acrylic fibers as the starting material and pitch-based carbon fibers that use pitch, for example, can be employed. As the belt-shaped conductor 10 of this embodiment, a bundle of carbon fibers bundled in a belt shape using, for example, a sizing agent can be employed.

Each of the carbon fibers preferably has a thickness of 1 μm or more and 20 μm or less. The thickness of the carbon fiber is more preferably 2 μm or more and 15 μm or less, particularly preferably 3 μm or more and 10 μm or less. The thickness of the carbon fiber and the thickness (T) of the belt-shaped conductor can be obtained by, for example, a micrometer. Generally, the thickness of the carbon fiber and the thickness (T) of the belt-shaped conductor are respectively obtained as the arithmetic mean of the values measured at a plurality of places selected at random. The thickness of the carbon fiber is in principle obtained through measurement using the micrometer; however, in the case, for example, where the carbon fiber is too thin to be measured by the micrometer, or has a cross section so different from a circular shape that it seems unsuitable for the measurement using the micrometer, then the diameter of a circle having the same area as the cross-sectional area of the carbon fiber obtained from an SEM image or the like, as aforementioned, can be regarded as the thickness of the carbon fiber. The thickness (T) of the belt-shaped conductor is also obtained through the measurement using the micrometer; however, in the case where the measurement using the micrometer is not suitable, such as the case where only one place or a plurality of places in the width direction are extremely thick (i.e., the case where partial projections are present), the cross-sectional area of the belt-shaped conductor that is obtained from a microscopic image or the like in a manner similar to the case of obtaining the thickness of the carbon fiber is divided by the width of the belt-shaped conductor so that the obtained value may be regarded as the thickness of the belt-shaped conductor.

The thickness (T) of the belt-shaped conductor 10 is generally 50 μm or more and 500 μm or less, preferably 60 μm or more and 300 μm or less, particularly preferably 70 μm or more and 200 μm or less. The width (W) of the belt-shaped conductor 10 having the aforementioned thickness is generally 0.8 mm or more and 3 mm or less, preferably 0.9 mm or more and 2.5 mm or less, more preferably 1 mm or more and 2 mm or less.

The number of carbon fibers forming the belt-shaped conductor 10 is generally 1000 or more and 24000 or less. The carbon fibers forming the belt-shaped conductor 10 do not need to share the same thickness or material with one another. Accordingly, the belt-shaped conductor 10 may have the PAN-based carbon fibers and the pitch-based carbon fibers mixed together, and have the carbon fibers having different thicknesses mixed together.

The material and the like of the covering material 20 that covers the belt-shaped conductor 10 is not particularly limited, but the covering material 20 can be formed of a polymer composition similar to that used for forming the covering material of a general lead wire. The covering material 20 of this embodiment is preferably of an electrically insulative polymer composition having a volume resistivity of $1\times10^{12}$ Ω·cm or more. Examples of polymers contained in the polymer composition as the main component of the polymer composition include thermoplastic polymers such as polyethylene, polypropylene, an ethylene-vinyl acetate copolymer, polyvinyl chloride, polystyrene, a styrene-acrylonitrile copolymer, polyester, polyamide, an acrylate polymer, a polyurethane-based thermoplastic elastomer, a styrene-based thermoplastic elastomer, and a polyolefin-based thermoplastic elastomer, and thermosetting polymers such as silicone rubber and urethane rubber.

The covering material 20 can be formed by melting and kneading the polymer composition containing any of the abovementioned polymers and then covering the belt-shaped conductor with the molten and kneaded product, and can be formed through the general extrusion method. In so doing, use of the polymer composition containing a crystalline polymer such as polyethylene, polypropylene, an ethylene-vinyl acetate copolymer, and polyamide to form the covering material 20 can increase the filling rate (%) as a result of shrinkage associated with crystallization after covering. However, the use of the polymer composition containing a crystalline polymer as the main component to form the covering material 20 causes necking in the polymer composition during the peeling process, and thereby causes the lead wire to easily form thread-like products extending from the cut end of the covering material 20 toward the exposed conductor portion 1*a*. It may be possible to incorporate an inorganic filler in the polymer composition to decrease a nominal strain at tensile breaking and thereby prevent the necking in the peeling process; however, in view of radiolucency, it is preferable that the content of the inorganic filler in the polymer composition for forming the covering material 20 be minimized. Therefore, it is preferable that the polymer composition of this embodiment have an amorphous polymer as the main component and an inorganic content of 5% by mass or less. Among amorphous polymers, polyvinyl chloride is suitable in that its mechanical characteristics can be easily adjusted by varying the content of a plasticizer and that it causes the covering material 20 to exert an appropriate nominal strain at tensile breaking.

Examples of the plasticizers to be added to the polymer composition containing the polyvinyl chloride include ester compounds such as a phthalic acid ester-based plasticizer, an adipic acid ester-based plasticizer, an azelaic acid ester-based plasticizer, a sebacic acid ester-based plasticizer, a maleic ester-based plasticizer, a fumaric acid ester-based plasticizer, a trimellitic acid ester-based plasticizer, a pyromellitic acid ester-based plasticizer, an itaconic acid ester-based plasticizer, a citric acid ester-based plasticizer, and a polyester-based plasticizer. The plasticizer to be incorporated in the polymer composition is preferably the phthalic acid ester-based plasticizer or the trimellitic acid ester-based plasticizer.

Examples of the phthalic acid ester-based plasticizer include dibutyl phthalate, butyl hexyl phthalate, di-heptyl phthalate, dioctyl phthalate [or bis(2-ethylhexyl)phthalate], diisononyl phthalate, diisodecyl phthalate, diundecyl phthalate, ditridecyl phthalate, dilauryl phthalate, dicyclohexyl phthalate, and dioctyl terephthalate.

Examples of the trimellitic acid ester-based plasticizer include tri (2-ethylhexyl) trimellitate, tri(n-octyl) trimellitate, and tri(isononyl) trimellitate. Among these, diundecyl phthalate, ditridecyl phthalate, diisononyl phthalate, diisodecyl phthalate, tri(2-ethylhexyl) trimellitate, tri(n-octyl) trimellitate, and tri(isononyl) trimellitate are particularly mentioned.

The polymer composition may further contain various coloring agents and functional chemicals such as an antioxidant, an aging inhibitor, a stabilizer, and a weathering agent.

It cannot be expected that use of the polymer composition containing polyvinyl chloride to form the covering material 20 causes as much shrinkage of the covering material 20 after extrusion as the case where the polymer composition containing a crystalline polymer is used to form the covering material 20. Therefore, full extrusion is preferably carried out when the covering material 20 is formed, in order to improve the filling rate of the belt-shaped conductor in the hollow interior. A general method for covering a wire with a polymer using the extruder is a method using the crosshead, and specifically, the method is broadly classified into full extrusion and tube extrusion in view of the positional relationship between the die and the nipple in the crosshead. Among these methods, the full extrusion involves covering while the end of the nipple through which the belt-shaped conductor 10 has been inserted is located on the upstream side of the outlet of the die. Therefore, in the full extrusion, the belt-shaped conductor is covered with the polymer composition that is molten and kneaded in a condition of a high resin pressure before passing through the die.

The lead wire 1 fabricated by the full extrusion allows the carbon fibers of the belt-shaped conductor 10 to tightly adhere to one another, thereby capable of decreasing conductor resistance. In the full extrusion, the resin pressure acts on the belt-shaped conductor 10 between the nipple end and the die outlet, and thus the inner wall surface of the covering material 20 is formed to have projections and recesses corresponding to the projections and recesses of the outer surface of the belt-shaped conductor 10. In the conductor formed simply of a bundle of carbon fibers in a rounded shape, recesses formed in the conductor surface hardly have a depth being equal to or larger than the thickness of the carbon fibers. However, in this embodiment where the belt-shaped conductor 10 is used, a groove 10*a* having a depth equivalent to the thickness of the belt-shaped conductor 10 is formed along an edge in the width direction of the belt-shaped conductor 10. In addition, since the belt-shaped conductor 10 of this embodiment is twisted, the groove 10*a* can be formed in a spiral shape around the outer circumference of the belt-shaped conductor 10. In this embodiment, the pull-out resistance of the belt-shaped conductor 10 is further increased since the polymer composition intrudes into the groove 10*a*. As described above, the lead wire of this embodiment facilitates performing the peeling process, and can expect an effect of decreasing the conductor resistance.

This embodiment is described by taking, for example, the case where the lead wire is used for X-ray transmission; however, the intended use of the lead wire of the present invention is not limited thereto. In the aforementioned exemplification, a lead wire having only one belt-shaped conductor is described; however, the lead wire of the present invention may include two or more belt-shaped conductors. That is, the present invention is not limited to the aforementioned exemplification.

EXAMPLES

Hereinafter, the present invention will be further described by the following examples, without limitation thereto.

Prepared was a belt-shaped conductor fabricated to have a thickness of about 0.1 mm and a width of about 1.5 mm (flatness ratio: about 15), using about 3000 carbon fibers about 7 μm thick. Also separately prepared was a polymer composition containing polyvinyl chloride as the main component for forming a covering material. The polymer composition was fed to an extruder equipped with a crosshead at the end, and molten and kneaded in the extruder. At the same time, the belt-shaped conductor was inserted through the nipple of the crosshead. The molten and kneaded product was fed to the crosshead at a constant screw rotation speed of the extruder, and discharged from the die mounted on the crosshead. The nipple was fixed so that the end thereof is located on the upstream side of the outlet of the die and at the center of the die, and the belt-shaped conductor that is being inserted through the nipple was pulled at a constant speed to fabricate a lead wire having a circular cross section and a finished outer diameter of about 1 mm. The lead wire had a hollow interior having a circular cross section and a diameter of about 0.5 mm in the cross section of the lead wire, and the hollow interior was filled with the carbon fibers.

Four types of belt-shaped conductors to be fed into the crosshead were prepared, namely: a belt-shaped conductor that is not twisted (i.e., having an infinite twist pitch), and belt-shaped conductors respectively having twist pitches of 30 mm, 50 mm, and 75 mm. These belt-shaped conductors were used to fabricate lead wires. For each of the fabricated lead wires, the filling rate of the carbon fibers (CF), i.e., the area ratio of the carbon fibers occupied in the hollow interior, and the resistance per meter long of each lead wire (conductor resistance) were measured, and appearance measurements were carried out for a sensory evaluation as to whether or not the surface of each covering material has projections and recesses. The results are shown in the table below. Fabrication of lead wires using the different types of the conductors were carried out 10 times for each type of the conductors. The filling rate (%) of the carbon fibers and the lead wire resistance (Ω/m) were measured for each lead wire fabricated, and each of the measurements was carried out a total of 10 times for each fabricated lead wire. The average value of the results of the 10-time measurements is shown in the table below.

TABLE 1

| | #1 | #2 | #3 | #4 |
|---|---|---|---|---|
| Twist pitch of belt-shaped conductor (mm) | 30 mm | 50 mm | 75 mm | Infinite |
| Method of fabrication (extrusion) | Full extrusion | Full extrusion | Full extrusion | Full extrusion |
| Appearance (presence of projections and recesses) | Absent | Absent | Absent | Present |
| Cross-sectional area of hollow interior ($mm^2$) | 0.15-0.17 | 0.15-0.16 | 0.15-0.19 | 0.14-0.17 |
| CF filling rate in hollow interior (%) | 70.9 | 74 | 67.5 | 76.5 |
| Resistance (Ω/m) | 126.1 | 130 | 130.3 | 128.7 |

It was confirmed that the belt-shaped conductors were hardly pulled out from the aforementioned lead wires during the peeling process. Also, it was found from the aforementioned results that the twisted belt-shaped conductors were advantageous in imparting an excellent appearance to the lead wire.

REFERENCE SIGNS LIST

1: Lead wire
10: Belt-shaped conductor
20: Covering material

The invention claimed is:

1. A lead wire having a circular cross section, comprising:
a belt-shaped conductor formed of a plurality of carbon fibers; and
a covering material in a tubular shape covering the belt-shaped conductor,
wherein the plurality of carbon fibers extend in a lengthwise direction of the belt-shaped conductor and are arranged in parallel with one another,
wherein the belt-shaped conductor is arranged in a rolled-up state in the covering material, and thereby causes a restoring force on an inner wall of the covering material, and
wherein the restoring force is the result of the belt-shaped conductor attempting to return to a state prior to being rolled-up.

2. The lead wire according to claim 1, wherein
a filling rate (%) expressed by Formula (1) below is 60% or more and 95% or less:

$$\text{Filling rate (\%)}=(S_2/S_1)\times 100\% \quad (1)$$

where:
$S_1$ ($mm^2$) represents an area of a cross section of a hollow interior obtained by cutting the covering material along a plane orthogonal to a lengthwise direction thereof; and
$S_2$ ($mm^2$) represents an area in which the plurality of carbon fibers are present in the hollow interior.

3. The lead wire according to claim 1, wherein the belt-shaped conductor is twisted, with a pitch of more than 5 mm and less than 50 mm.

4. The lead wire according to claim 2, wherein the belt-shaped conductor is twisted, with a pitch of more than 5 mm and less than 50 mm.

5. The lead wire according to claim 1, wherein the belt-shaped conductor has a thickness of 50 μm or more and 500 μm or less, and a width of 0.8 mm or more and 3 mm or less.

6. The lead wire according to claim 1, wherein the covering material is formed of a polymer composition.

7. The lead wire according to claim 6, wherein the covering material is formed of an electrically insulative polymer composition.

* * * * *